US008490420B2

(12) United States Patent
Resch

(10) Patent No.: US 8,490,420 B2
(45) Date of Patent: Jul. 23, 2013

(54) REFRIGERATING DEVICE

(75) Inventor: Reinhold Resch, Rottenmann (AT)

(73) Assignee: AHT Cooling Systems GmbH, Rottenmann (AT)

( * ) Notice: Subject to any disclaimer, the term of this patent is extended or adjusted under 35 U.S.C. 154(b) by 835 days.

(21) Appl. No.: 11/921,777

(22) PCT Filed: Feb. 6, 2006

(86) PCT No.: PCT/AT2006/000045

§ 371 (c)(1),
(2), (4) Date: Nov. 19, 2009

(87) PCT Pub. No.: WO2006/130886

PCT Pub. Date: Dec. 14, 2006

(65) Prior Publication Data

US 2009/0217688 A1 Sep. 3, 2009

(30) Foreign Application Priority Data

Jun. 8, 2005 (AT) ..... A 966/2005

(51) Int. Cl.
*F25D 21/14* (2006.01)
*F25D 23/00* (2006.01)

(52) U.S. Cl.
USPC ..... 62/150; 62/285

(58) Field of Classification Search
USPC ..... 62/150, 285
See application file for complete search history.

(56) References Cited

U.S. PATENT DOCUMENTS

| | | | | | |
|---|---|---|---|---|---|
| 2,016,327 | A | * | 10/1935 | Green | 62/93 |
| 2,065,537 | A | * | 12/1936 | Philipp | 62/227 |
| 2,090,413 | A | * | 8/1937 | Gould | 62/150 |
| 2,130,092 | A | * | 9/1938 | Kettering | 62/285 |
| 2,580,535 | A | * | 1/1952 | Feinberg | 62/285 |
| 3,224,216 | A | * | 12/1965 | Crouch | 62/140 |
| 5,070,707 | A | * | 12/1991 | Ni | 62/234 |
| 5,201,192 | A | * | 4/1993 | Hara | 62/285 |

(Continued)

FOREIGN PATENT DOCUMENTS

| | | | |
|---|---|---|---|
| AU | 61026 80 | A | 2/1981 |
| EP | 1 184 635 | A | 3/2002 |

(Continued)

OTHER PUBLICATIONS

Oxford English Dictionary, Online Edition "impinged" retrieved Dec. 13, 2011 http://www.oed.com/view/Entry/92408?redirectedFrom=impinge#eid.*

(Continued)

*Primary Examiner* — Ljiljana Ciric
*Assistant Examiner* — Alexis Cox
(74) *Attorney, Agent, or Firm* — Collard & Roe, P.C.

(57) ABSTRACT

A refrigerating device for deep-frozen products has a coolant loop including a compressor, a condenser, a throttle, and an evaporator. The device also has a product chamber temperature-impinged by the evaporator, and a control unit provided for deicing, which works together with the coolant loop in such a way that upon deicing, both the evaporator and also a drainage channel provided for receiving the condensed water are heated. The evaporator impinges the temperature of the product chamber via the side wall of the product chamber, and at least the side wall impinged by the evaporator has the drainage channel, the evaporator at least partially heating the drainage channel upon deicing of the product chamber.

7 Claims, 3 Drawing Sheets

U.S. PATENT DOCUMENTS

| | | | | |
|---|---|---|---|---|
| 5,499,514 | A * | 3/1996 | Ho | 62/291 |
| 5,784,896 | A * | 7/1998 | Tronnes et al. | 62/407 |
| 2002/0053218 | A1* | 5/2002 | Wightman | 62/513 |
| 2012/0180514 | A1* | 7/2012 | Lee et al. | 62/285 |

FOREIGN PATENT DOCUMENTS

| | | | |
|---|---|---|---|
| FR | 1 288 684 | A | 2/1962 |
| FR | 2 304 042 | A | 10/1976 |
| FR | 2 611 872 | | 9/1988 |
| GB | 1 457 871 | A | 12/1976 |
| GB | 2 175 384 | A | 11/1986 |
| JP | 05 106943 | A | 8/1993 |
| JP | 05302780 | A | 11/1993 |
| JP | 10318659 | A | 12/1998 |
| JP | 2004 183998 | A | 7/2004 |

OTHER PUBLICATIONS

Oxford English dictionary, Online Edition "profiled" retrieved Dec. 13, 2011 http://www.oed.com/view/Entry/267279?redirectedFrom=profiled#eid.*

International Search Report, Jun. 7, 2006.

* cited by examiner

REFRIGERATING DEVICE

CROSS REFERENCE TO RELATED APPLICATIONS

Applicant claims priority under 35 U.S.C. §119 of Austrian Application No. A 966/2005 filed Jun. 8, 2005. Applicant also claims priority under 35 U.S.C. §365 of PCT/AT2006/000045 filed Feb. 6, 2006. The international application under PCT article 21(2) was not published in English.

FIELD OF THE INVENTION

The present invention relates to a refrigerating device for deep-frozen products having a coolant loop comprising a compressor, a condenser, a throttle, and an evaporator, having a product chamber temperature-impinged by the evaporator, and having a control unit provided for deicing, which works together with the coolant loop in such a way that both the evaporator and also a drainage channel provided for receiving the condensed water are heated upon deicing.

DESCRIPTION OF THE PRIOR ART

Deep-freezing devices, such as freezer chests, are known from the prior art, which deep-freeze products in a product chamber via an evaporator of a coolant loop, their evaporator usually being laid in the side walls of the product chamber to thus be able to dispense with situating the evaporator in the product chamber. Because refrigerating devices predominantly ice at the points impinged by cold, providing a control unit for thawing ice formations in refrigerating devices is also known. Typical control units shut down the coolant loop during deicing of the product chamber, so that ice layers may be thawed out with the aid of the ambient temperature, as a result of which condensed water collects on the floor of the refrigerating device. In order that the deep-frozen products stored in the product chamber are not also heated and/or thawed, the product chamber must be emptied before every such deicing. The product chamber is to be dried following thawing, which results in a significance maintenance outlay for refrigerating devices of this type. For this reason, refrigerating devices of this type are also not especially suitable for offering deep-frozen products in businesses, because there is a high danger of icing precisely therein, in particular as a result of continuous opening and closing of the device.

Furthermore, refrigerators are known from the prior art (JP 05302780 A) having a drainage channel below an evaporator provided in the product chamber. Such drainage channels receive the ambient moisture precipitating on the evaporator during refrigerating operation. Refrigerators are known to only have an insignificant danger of icing. However, if icing occurs, it may be thawed out using the coolant loop, in that the coolant loop reverses its flow direction and the evaporator thus heated thaws out icing. In order that the drainage channel may also be heated, a connection line of the coolant loop is guided through the drainage channel. Refrigerating devices of this type have a comparatively complex construction, and are not suitable for deep-freezing operation. Specifically, a comparatively high heat output must be introduced into the product chamber for the deicing to be able to ensure drainage of the condensed water. Impermissible heating of the products stored in the product chamber may therefore not be precluded, so that the products must be removed from the product chamber upon deicing, which again requires a high maintenance outlay.

SUMMARY OF THE INVENTION

It is therefore the object of the present invention to design a refrigerating device for deep-frozen products of the type described at the beginning having a simple design in such a way that a maintenance outlay caused by icing may be kept low.

The present invention achieves the stated object in that the evaporator impinges the temperature of the product chamber via the side wall of the product chamber, and at least the side wall impinged by the evaporator has the drainage channel, the evaporator at least partially heating the drainage channel during deicing of the product chamber.

If the product chamber has a drainage channel for the condensed water on at least the side wall impinged by the evaporator, not only may the condensed water be removed easily by the channel upon deicing of the refrigerating chamber, but rather, if the evaporator impinges the temperature of the product chamber via this side wall of the product chamber, the drainage channel is at least partially also heated, which ensures safe removal of the condensed water, although a comparatively low temperature of the deep-frozen products acts on the drainage channel. Therefore, the deep-frozen products may remain in the product chamber during deicing, so that the refrigerating device for deep-frozen products according to the present invention is particularly distinguished by its ease of operation and by the comparatively low maintenance outlay in regard to an ice-free product chamber. It is unimportant whether the drainage channel is provided as a separate component in the product chamber, or is shaped in the side wall of the refrigerating device. In addition, a uniform temperature distribution may be achieved in the product chamber if the evaporator impinges the temperature of the product chamber via the side wall of the product chamber.

Simple design conditions result if the control unit heats the side wall of the product chamber with the aid of the coolant loop during deicing of the product chamber, because in this case the coolant loop provided for refrigerating operation may also be used for deicing the product chamber. This may be achieved easily in that the control unit opens a bypass line running in the coolant loop parallel to the throttle and preferably parallel to the condenser, this bypass line opening into the evaporator and being able to be blocked. Hot coolant flows from the compressor via the bypass line directly into the evaporator, which causes heating of the evaporator, by which the product chamber may be deiced.

If the drainage channel, which is preferably implemented as a profiled part, carries thermal insulation at least partially on the side facing toward the side wall, a cold impingement of the evaporator may be relayed to the drainage channel with a delay. This is advantageous in particular upon ending the deicing, because such a delayed cold impingement nonetheless allows condensed water to be drained further.

If the drainage channel is implemented by the side wall and by a profiled part fastened to the side wall, advantageous removal conditions result for the condensed water, because the heated side wall also makes the removal of the condensed water easier as a part of the channel. In addition, no material transition has to be overcome by the draining condensed water so that it may then be received by the drainage channel, so that droplet formations at the inlet of the drainage channel, which in turn result in visible icing, may be avoided.

If the profiled part of the drainage channel is attached essentially below the evaporator, the drainage channel may thus be situated offset out of the area endangered by icing. Ice formations on the drainage channel are thus largely to be avoided. To preclude the freezing of condensed water located in the drainage channel, an electrical auxiliary heater may be assigned to the drainage channel. Depending on whether drainage of condensed water is desired even in refrigerating operation, the control unit may turn on this electrical auxiliary heater. In addition, the part of the drainage channel which is closest in relation to the products refrigerated in the product chamber may also be heated using the auxiliary heater, by which freezing of the condensed water by the cold radiation of the products may be precluded upon deicing of the product chamber.

A spacer, for example, in the form of a lattice insert, may be provided in the product chamber for spacing apart the refrigerated products from both the side wall impinged by the evaporator and also from the drainage channel. Therefore, impingement of the products with condensed water and also heating of the deep-frozen products because they press against the side wall may be prevented upon deicing of the product chamber.

BRIEF DESCRIPTION OF THE DRAWING

The present invention is described for exemplary purposes on the basis of exemplary embodiments in the drawings.

DESCRIPTION OF THE PREFERRED EMBODIMENT

Figure 1:
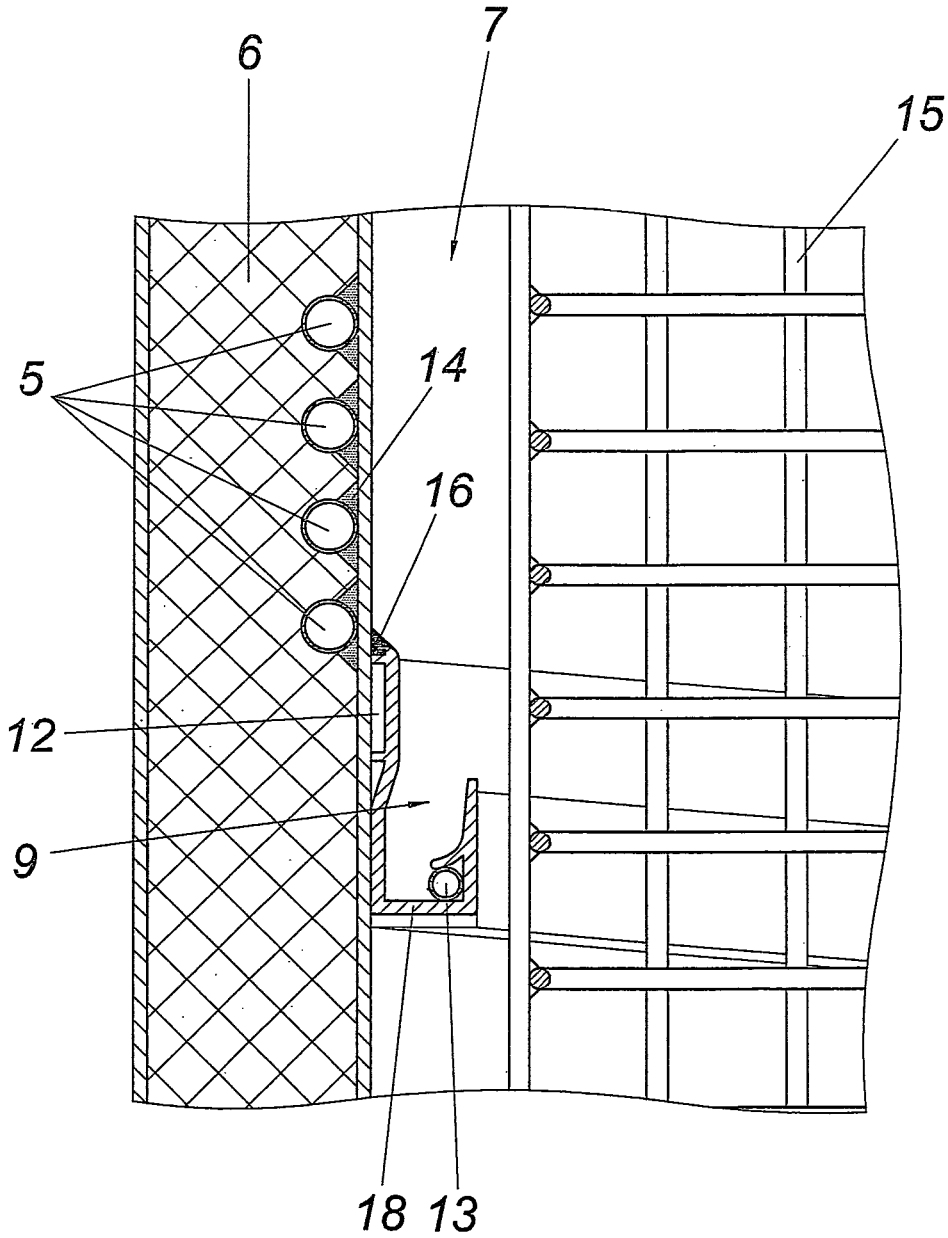
FIG. 1 shows a cutaway side view of the refrigerating device according to the present invention.
Figure 2:
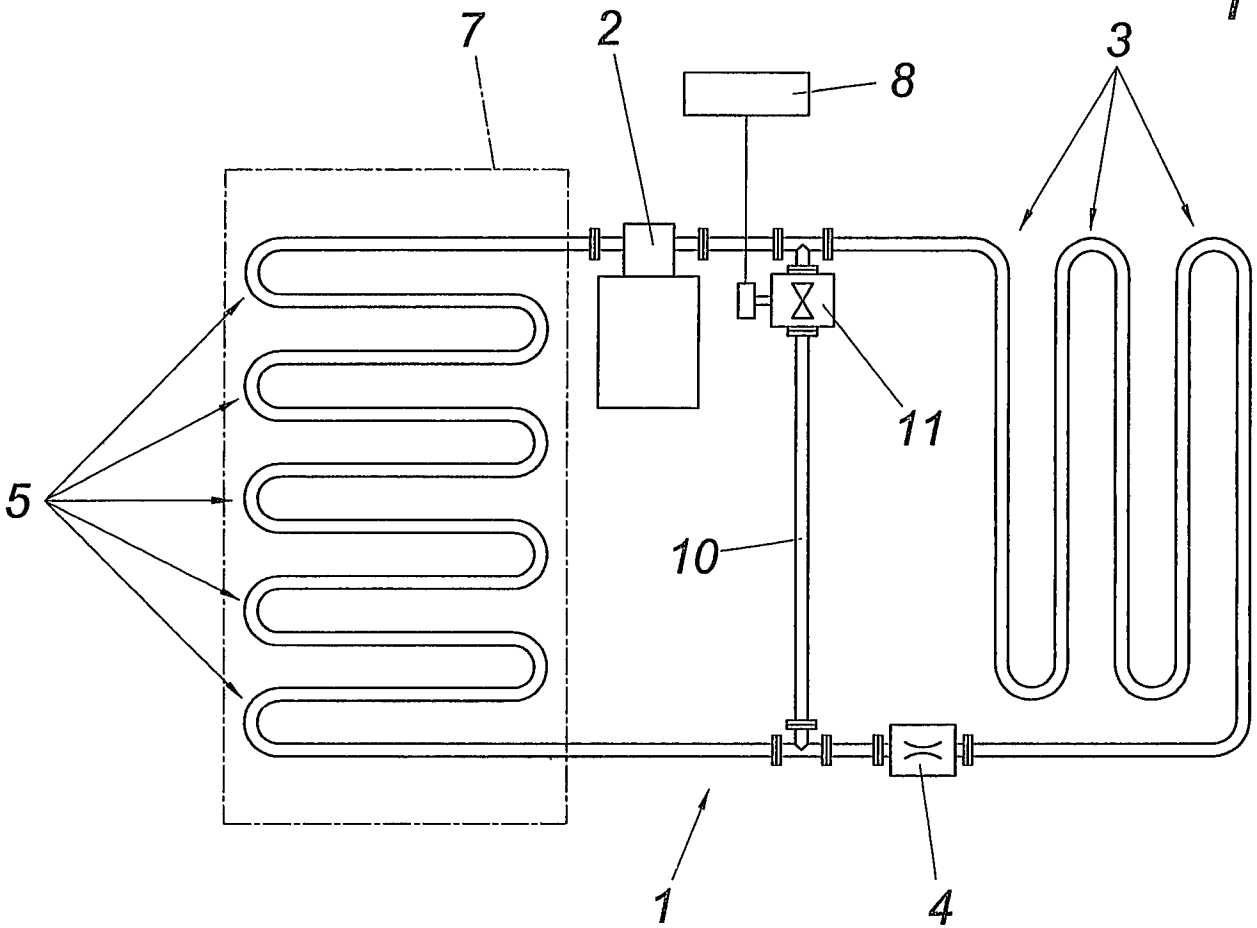
FIG. 2 shows a schematic illustration of the coolant loop of the refrigerating device from FIG. 1.

The refrigerating device for deep-frozen products illustrated as an example has a coolant loop 1 comprising a compressor 2, a condenser 3, a throttle 4, and an evaporator 5 (FIG. 2). The evaporator 5 impinges a side wall 6 of the product chamber 7 (FIG. 1), in which products (not shown in greater detail) are deep-frozen. A control unit 8 is provided for deicing the product chamber 7, and a drainage channel 9, 17 for the condensed water is provided in the product chamber 7 on the side wall 6 impinged by the evaporator, the control unit 8 at least partially heating the drainage channel 9, 17 via the side wall 6 impinged by the evaporator upon deicing of the product chamber 7. Therefore, it may be ensured that condensed water running off of the side wall 6 flows into the drainage channel 9, 17, without having to fear freezing of the condensed water because of the cold of the deep-frozen products.

The side wall 6 may be heated using a simple design with the aid of the evaporator 5, in that the control unit 8 opens a bypass line 10, which runs in the coolant loop 1 parallel to the throttle 4 and the condenser 3, via a closing valve 11 (FIG. 2). The bypass line 10 thus conducts hot coolant gas from the compressor 2 into the evaporator 5, which results in heating of the evaporator 5, so that the side wall 6 may be deiced via the heated evaporator 5.

The drainage channel 9 according to the first exemplary embodiment from FIG. 1 carries thermal insulation 12 in the form of an air chamber on the side facing toward the side wall, which delays cooling of the drainage channel 9 in relation to the side wall 6. In particular during the transition from deicing to refrigerating operation, freezing of condensed water still located in the drainage channel 9 may thus accordingly be delayed enough that it is still possible for the condensed water to flow away.

Figure 3:
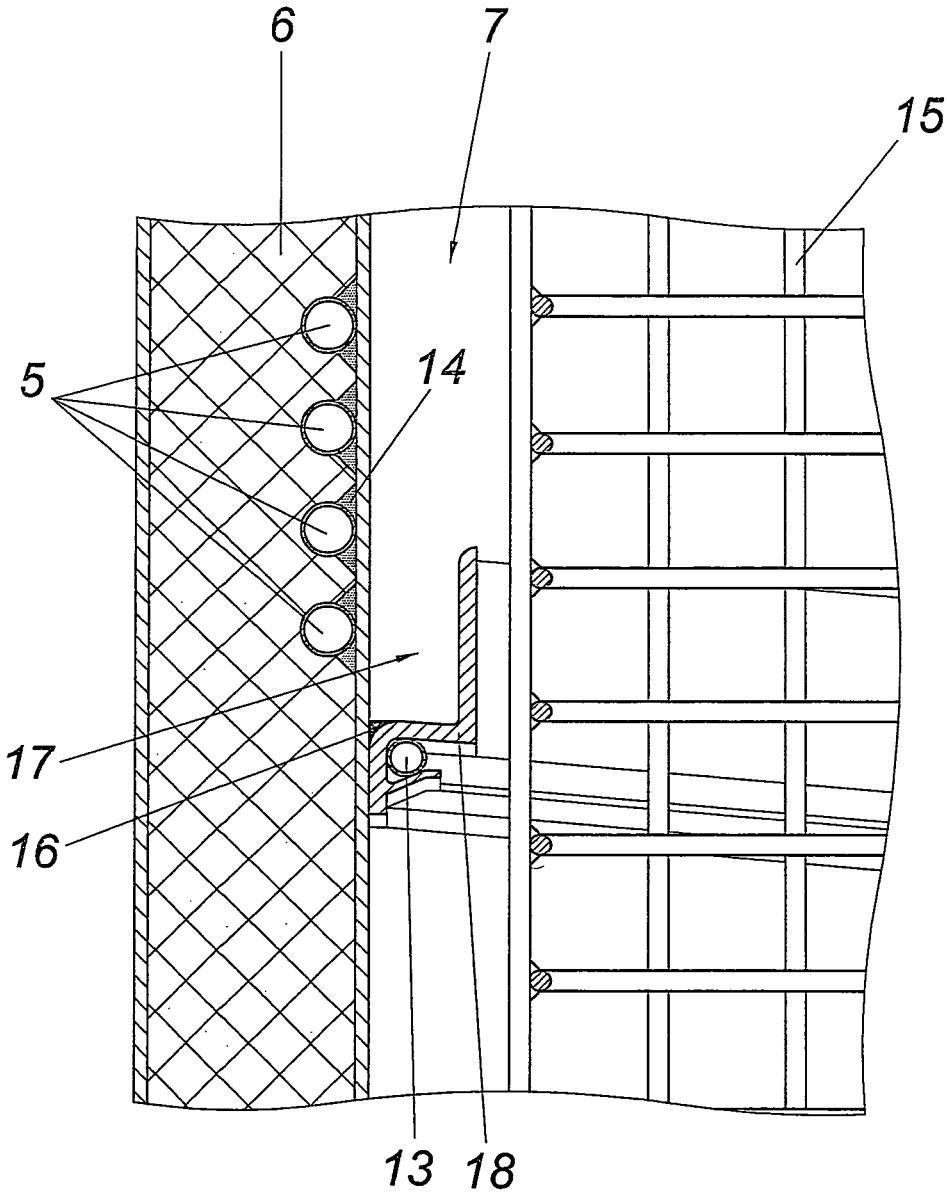
FIG. 3 shows a cutaway side view of a further exemplary embodiment of the refrigerating device according to the present invention.

The drainage channel 17 may be implemented in a further exemplary embodiment from FIG. 3 by the side wall 6 and a profiled part 18 fastened to the side wall, which makes it easier to introduce and remove condensed water.

The profiled part 18 of the drainage channel 9, 17 is attached essentially below the evaporator 5, so. that the drainage channel 9, 17 is situated spaced apart in the product chamber 7 from the area of the side wall 6 endangered by icing. The drainage channel 9, 17 guides an electrical auxiliary heater 13, so that possible ice formations in the drainage channel 9, 17 may be thawed out comparatively rapidly. The evaporator 5 is embedded in a thermal conductor 14 on its side adjoining the side wall 6, which improves the heat transfer to the side wall 6. The drainage channel 9, 17 opens into an air trap to the outside (not shown), which keeps the cold air of the product chamber 7 from flowing away. All side walls 6 of the refrigerating device are preferably impinged by the evaporator, so that the drainage channel 9, 17 is drawn over all side walls 6 of the product chamber 7 inclined in the direction of the air trap.

Using a spacer 15 in the form of a lattice insert, the products may be kept at a distance from the side wall 6 impinged by the evaporator and also from the drainage channel 9, 17, so that heating of the deep-frozen products in the product chamber 7 may be precluded upon deicing of the product chamber 7. In addition, a lattice insert is easily removable for cleaning purposes of the product chamber 7.

The drainage channel 9, 17 carries a recess for inserting a sealing material 16 between the drainage channel 9, 17 and the side wall 6.

The invention claimed is:

1. A refrigerating device for deep-frozen products, the refrigerating device having:

a coolant loop, the coolant loop comprising
- a compressor,
- a condenser,
- a throttle, and
- an evaporator;

a product chamber having a first side wall, the first side wall separating the evaporator from the product chamber, the evaporator performing a thermal transfer to the product chamber to affect a temperature of the product chamber, wherein the thermal transfer occurs by conduction through the first side wall, and wherein an area of the first side wall facing the product chamber and nearest the evaporator is endangered by icing;

a control unit provided for deicing; and a drainage channel for receiving condensed water, the first side wall having the drainage channel on a side of the first side wall nearest the product chamber, with at least a portion of the drainage channel being disposed below the area immediately opposite the evaporator;

wherein the control unit works together with the coolant loop in such a way that, upon deicing, the evaporator at least partially heats the drainage channel via conduction through the first side wall.

2. The refrigerating device according to claim 1, wherein, for deicing the product chamber with aid of the coolant loop, the control unit opens a bypass line, the bypass line running in the coolant loop parallel to the throttle, and wherein the bypass line opens into the evaporator and may be blocked.

3. The refrigerating device according to claim 2, wherein the bypass line runs in the coolant loop parallel to the condenser.

4. The refrigerating device according to claim 1, wherein the drainage channel carries thermal insulation at least partially on a side of the drainage channel facing toward the first side wall.

5. The refrigerating device according to claim 1, wherein the drainage channel is implemented by the first side wall and by a carrier element fastened to the first side wall.

6. The refrigerating device according to claim 5, wherein the carrier element of the drainage channel is attached below the evaporator, wherein the carrier element carries an electrical auxiliary heater able to be switched on by the control unit, and wherein the electrical auxiliary heater is assigned to the drainage channel.

7. The refrigerating device according to claim 1, wherein a spacer, for spacing apart refrigerated products from both the first side wall and also the drainage channel, is provided in the product chamber.

* * * * *

UNITED STATES PATENT AND TRADEMARK OFFICE

CERTIFICATE OF CORRECTION

PATENT NO. : 8,490,420 B2
APPLICATION NO. : 11/921777
DATED : July 23, 2013
INVENTOR(S) : Reinhold Resch It is certified that error appears in the above-identified patent and that said Letters Patent is hereby corrected as shown below:

On the Title page, item [86] change "November 19, 2009" to correctly read:
--November 19, 2008--.

Signed and Sealed this
Twenty-third Day of December, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,490,420 B2
APPLICATION NO. : 11/921777
DATED : July 23, 2013
INVENTOR(S) : Reinhold Resch It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1291 days.

Signed and Sealed this
Eighth Day of September, 2015

Michelle K. Lee

Michelle K. Lee
*Director of the United States Patent and Trademark Office*